US010653244B2

(12) United States Patent
Yang

(10) Patent No.: US 10,653,244 B2
(45) Date of Patent: May 19, 2020

(54) PORTABLE ROCKING CHAIR

(71) Applicant: Zhejiang Hengfeng Top Leisure Co., Ltd., Wukang Town (CN)

(72) Inventor: Baoqing Yang, HangZhou (CN)

(73) Assignee: Zhejiang Hengfeng Top Leisure Co., Ltd., Wukang Town (CN)

( * ) Notice: Subject to any disclaimer, the term of this patent is extended or adjusted under 35 U.S.C. 154(b) by 144 days.

(21) Appl. No.: 16/028,639

(22) Filed: Jul. 6, 2018

(65) Prior Publication Data

US 2019/0029430 A1 Jan. 31, 2019

Related U.S. Application Data

(60) Provisional application No. 62/537,524, filed on Jul. 27, 2017.

(51) Int. Cl.

| | |
|---|---|
| ***A47C 4/44*** | (2006.01) |
| ***A47C 3/025*** | (2006.01) |
| ***A47C 4/02*** | (2006.01) |
| ***A47C 4/28*** | (2006.01) |

(52) U.S. Cl.

CPC ..... *A47C 4/44* (2013.01); *A47C 3/025* (2013.01); *A47C 4/02* (2013.01); *A47C 4/286* (2013.01)

(58) Field of Classification Search

CPC .. A47C 4/44; A47C 3/025; A47C 4/02; A47C 4/286

USPC ..... 297/16.1, 33

See application file for complete search history.

(56) References Cited

U.S. PATENT DOCUMENTS

| | | | | |
|---|---|---|---|---|
| 1,136,099 | A | 2/1873 | Russell | |
| 1,782,763 | A | 11/1930 | Overbey | |
| D179,878 | S | 3/1957 | Bernier | |
| 2,879,831 | A | 3/1959 | Williamson | |
| 3,114,572 | A | 12/1963 | Hopkins | |
| 5,269,591 | A * | 12/1993 | Miga, Jr. ..... | A47D 13/107 297/16.1 |
| 5,560,675 | A | 10/1996 | Altheimer et al. | |
| 5,702,152 | A | 12/1997 | Shaw | |
| 6,398,297 | B1 | 6/2002 | Cantwell | |
| 6,439,656 | B1 | 8/2002 | Liu | |
| 7,100,975 | B1 | 9/2006 | Zheng | |
| 9,060,611 | B2 | 6/2015 | Grace | |
| 9,282,824 | B2 | 3/2016 | Grace | |
| 2011/0148155 | A1* | 6/2011 | Chapman ..... | A47D 9/005 297/16.1 |

(Continued)

*Primary Examiner* — Anthony D Barfield
(74) *Attorney, Agent, or Firm* — Thompson Coburn LLP

(57) ABSTRACT

A rocking chair has a frame with first and second leg hubs. The first and second leg hubs each have leg member openings for leg members. The frame also has first and second seat hubs. The seat hubs have seat member openings for seat members. The first and second leg hubs form a leg support frame and the first and second seat hubs form a seat support frame. The leg support frame is rotatably connected to the seat support frame with a biasing member extending therebetween configured to urge against rotation in either direction. The leg members detachably connect to the first and second leg hubs at the leg member openings. The seat members detachably connect to the seat hubs at the seat member openings. Seat connector pockets are provided on the corners of the seat portion to allow the seat portion to detachably connect to the seat members.

30 Claims, 11 Drawing Sheets

(56) References Cited

U.S. PATENT DOCUMENTS

| | | | | |
|---|---|---|---|---|
| 2012/0104805 | A1* | 5/2012 | Lah | A47C 4/02 297/16.1 |
| 2014/0232154 | A1 | 8/2014 | Chen | |

* cited by examiner

PORTABLE ROCKING CHAIR

RELATED APPLICATION DATA

This application claims the benefit of provisional application Ser. No. 62/537,524, filed Jul. 27, 2017, the disclosure of which is incorporated by reference herein.

BACKGROUND

The present disclosure relates to a portable rocking chair. The rocking chair may comprise a pliable seat member and support frame where each may be folded to form a compact package for storage.

DETAILED DESCRIPTION OF THE DRAWINGS

DETAILED DESCRIPTION

Figure 1:
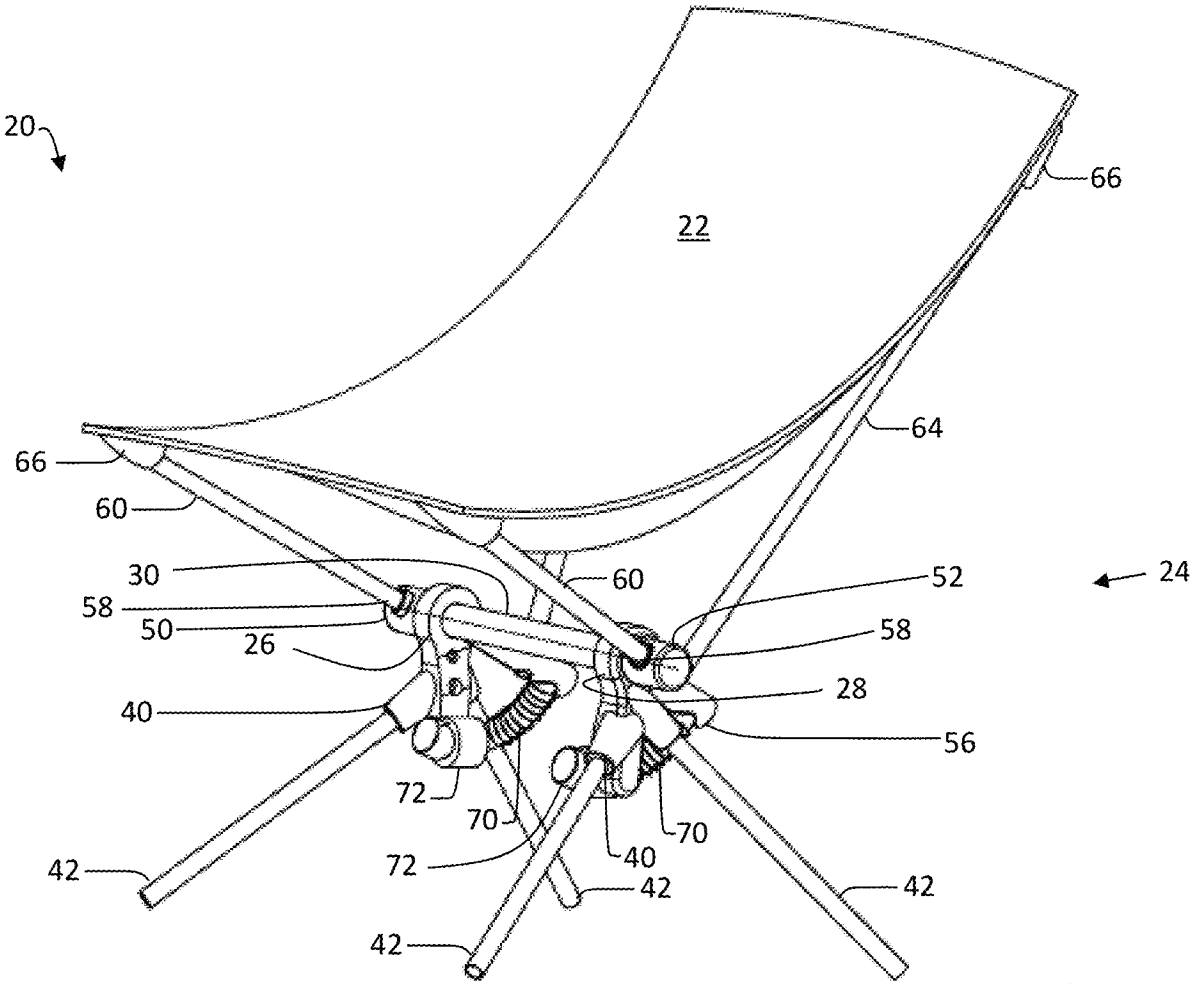
FIG. 1 shows a perspective view of an exemplary rocking chair.
Figure 2:
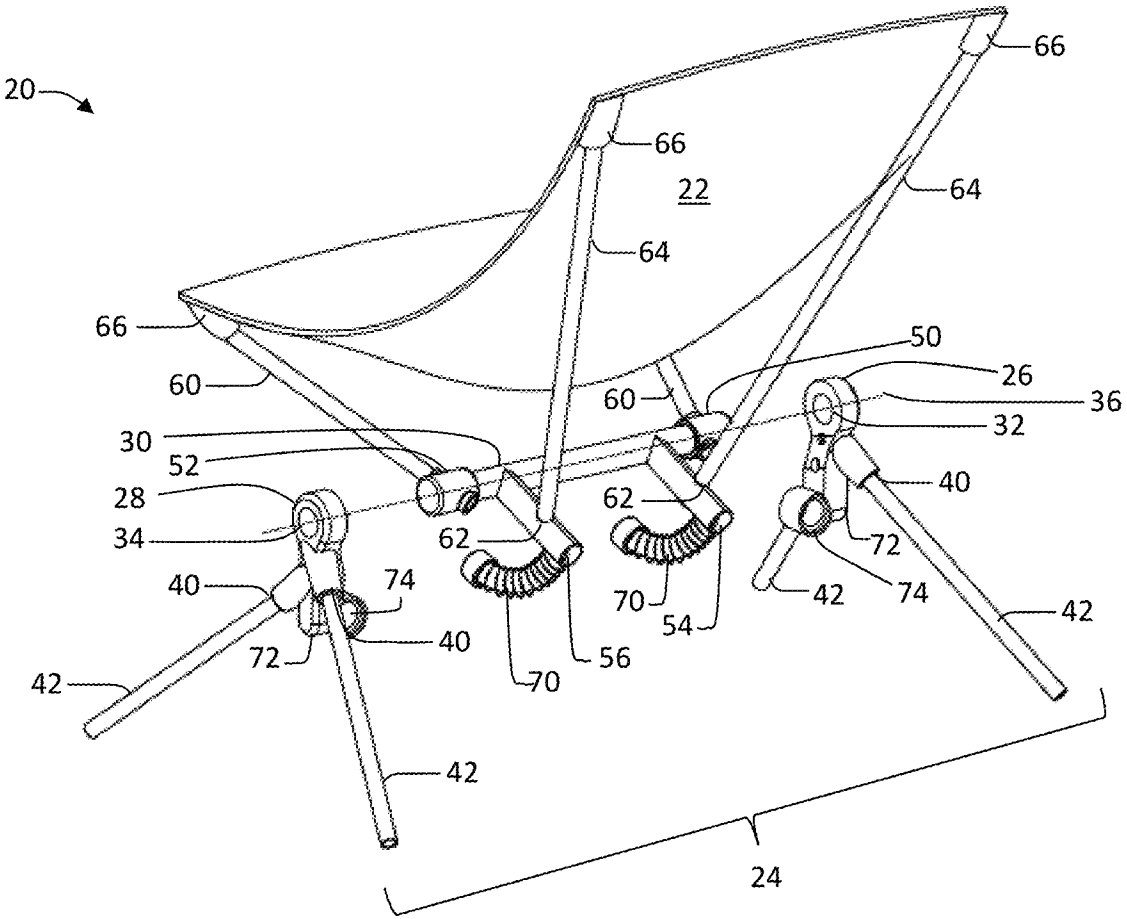
FIG. 2 is an exploded view of the rocking chair of FIG. 1.
Figure 3:
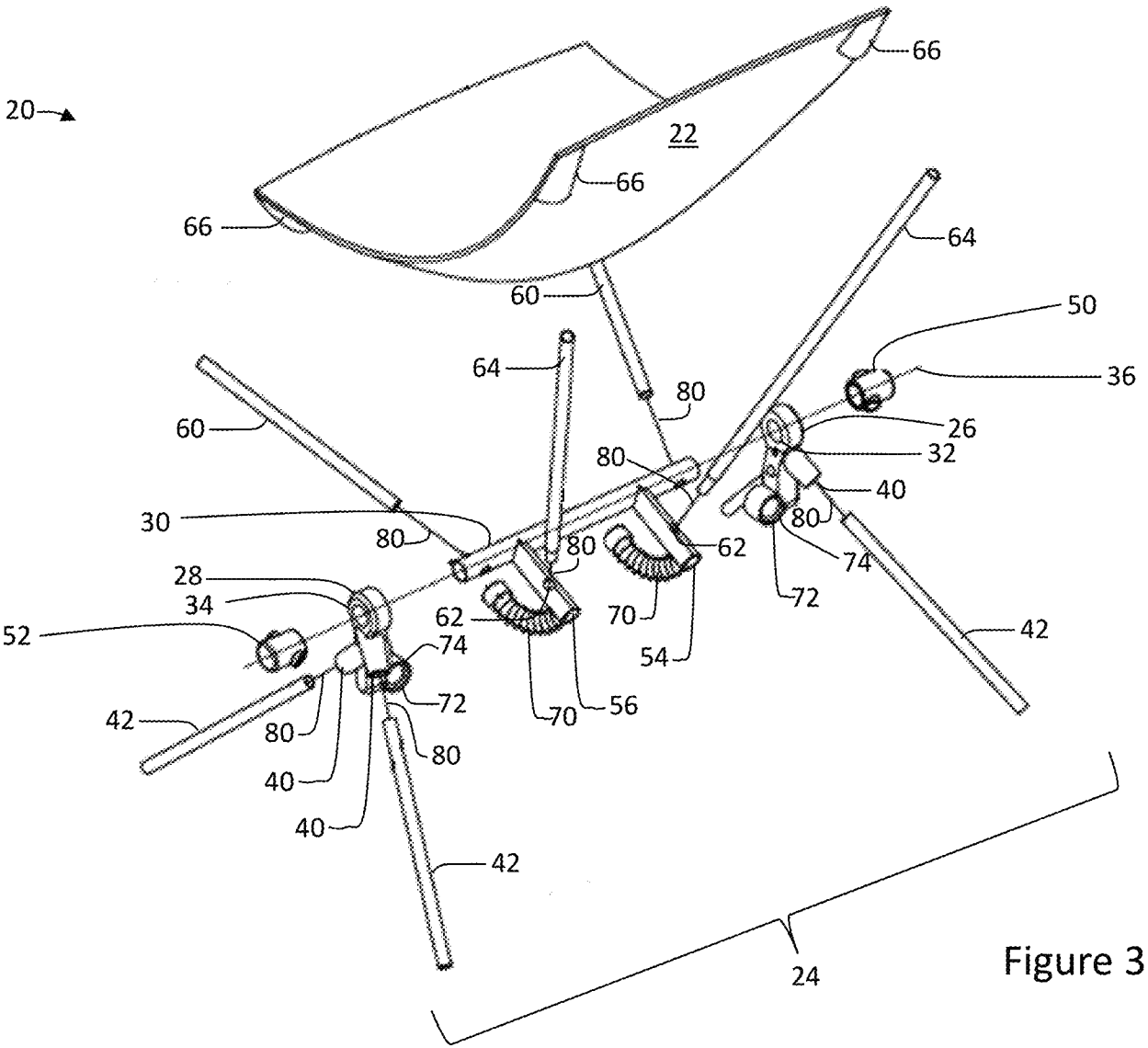
FIG. 3 is a further exploded view the rocking chair of FIG. 1.

Making reference to the embodiment of the rocking chair 20 shown in FIGS. 1-3, the chair comprises a pliable seat member 22 and a support frame 24 with left and right leg hubs 26,28 and a central support member 30 rotatably connected thereto. The leg hubs 26,28 have a central support member openings 32,34 that allow for the central support member 30 to pass through each of the hubs and permit relative rotary motion between the hubs and the central support member about a center axis 36. The leg hubs may be spaced apart from one another along center axis 36 of the central support member 30 to provide stability for the chair.

Each of the leg hubs 26,28 may have two leg hub leg member openings 40, and each leg hub leg member opening may receive a leg member 42. The chair may have four leg members 42, for instance, two left leg members and two right leg members. The leg hub leg member openings 40 may be angled from each other to allow the leg members 42 to be inserted therein at an angle in order to support the rocking chair when assembled. The angle may be less than or greater than 90°. The leg members 42 may be angled perpendicularly to the center axis 36 of the central support member 30 or angled axially outwardly in the direction of the center axis as the leg members project from the leg hubs 26,28.

In the embodiment of FIGS. 1-3, the support frame 24 may have left and right seat hubs 50,52 on opposite ends of the central support member 30. The left and right seat hubs

50,52 may be located on the central support member 30 outboard of the leg hubs 26,28 and fixed on the central support member. The central support member 30 may also have two rear extensions 54,56. The rear extensions 54,56 may project radially outward from (e.g., rearwardly relative to the orientation of the seat 22) of the central support member 30. The rear extensions 54,56 may be inboard of the leg hubs 26,28. Together, the rear extensions 54,56 and seat hubs 50,52 limit axial motion of the leg hubs 26,28 along the central support member center axis 36.

Each of the seat hubs 50,52 may have a seat hub seat member opening 58 adapted and configured to receive a seat member 60. As shown in the drawings, each of the seat hub seat member openings 58 extends forward (generally opposite of the rear extension 54,56) so as to support the seat portion 22 of the chair 20. Each of the rear extensions 54,56 may also have a seat member opening 62 to receive an extension seat member 64. The seat members 64 extending from the rear extensions may be used to support and provide a backrest of the seat portion 22. In the alternative, the seat hubs 50,52 may have another set of seat member openings to receive the seat members for supporting a back rest of the seat portion 22, thereby dispensing with the need for the rear extensions or rear extension member openings. In the alternative, the central support member may have member openings to receive the seat members for supporting the back rest portion, thereby dispensing with the need for the rear extensions or rear extension member openings. The seat hub leg member openings 58,62 may be angled from each other to allow the seat members 60,64 to be inserted therein at an angle in order to support the seat portion 22 of the rocking chair 20 when assembled. The angle may be less than or greater than 90°. The seat members 60,64 may be angled perpendicularly to the center axis 36 of the central support member 30 or angled axially outwardly in the direction of the center axis as the seat members project from the seat hubs 50,52 and the rear extensions 54,56.

The seat portion 22 comprises a pliable member and the seat members 60,64 of the support frame cooperate with the seat portion 22 to allow the seat portion to be releasably connected to the seat members. The seat portion 22 may include four seat connector pockets 66. Each seat connector pocket 66 is located on a distal corner of the seat. A distal end of each of the seat members 60,64 may be received in the connector pocket 66.

The central support member 30 may rotate relative to the leg hubs 26,28. Coil springs 70 may be disposed between the leg hubs 26,28 and the central support member 30 to bias the seat portion to a relatively neutral or level position with the backrest generally vertical and seat horizontal relative to a surface on which the chair is positioned. As shown in the drawings, the coil springs 70 extend between each of the rear extensions 54,56 and a depending portion 72 of each of the leg hubs 26,28. The depending portion 72 of the leg hubs 26,28 may have a coil spring locator 74 that receives to one end of the coil spring. The rear extensions 54,56 may have a mounting surface to receive the opposite end of the coil spring. The coil spring 70 may also be fixed to the respective rear extension 54.56, and/or also fixed to the coil spring locator 74 on the depending portion 72 of respective the leg hub 26,28, and may be positioned to limit the relative motion between the central support member 30 and the leg hubs 26,28. Making reference to FIG. 1, clockwise rotation of the central support member 30 relative to the leg hubs 26,28 will compress the coil spring 70, and the compression rate of spring and the relative distance between the locator 74 and the connection point of the coil spring with the rear extension 54,56 act together to limit the amount of rotation and force for rocking. In a like manner, counterclockwise rotation (reference to FIG. 1) will be limited as the coil spring (fixed to the locator 74 and rear extension 54,56) is expanded.

In moving the rocking chair of FIGS. 1-3 to the expanded arrangement as shown in FIG. 1, the leg members 42 may be inserted into the leg member openings 40 of the left and right leg hubs 26,28. Thereafter, the seat members 60,64 may be inserted into the seat member openings 58 of left and right seat hubs 50,52, and seat member openings 62 of the rear extensions 54,56. Then, the seat portion 22 may be assembled to the support frame 24 by inserting the seat members 60,64 into the seat connector pockets 66 of the seat portion. In folding the rocking chair to a folded configuration, the seat portion 22 may be removed from the support frame 24 by removing the seat members 60,64 from the seat connector pockets 66. The seat members 60,64 may be removed from the seat member openings 58 of the left and right seat hubs 50,52 and the seat member openings 62 of the rear extensions 54,56. The seat members 60,64 may be pivoted and brought into an arrangement parallel to the center member support 30. Thereafter, the leg members 42 may be removed from the leg member openings 40 of the left and right leg hubs 26,28 and moved to position parallel to the center support member 30.

To maintain the various members together as an intact unit and to prevent their separation from one another for easy storage, an elastic band 80 may be provided in the center of certain members. For instance, an elastic band 80 may run from the seat member 60 to the respective seat hub 50,52, from the seat member 64 to the respective rear extension 54,56, and from the leg member 42 to the respective leg hub 26,28. The elastic bands 80 may have a length and stretch that facilitates separation and manipulation of the seat and leg members to thereby allow a compact folding design for the rocking chair.

FIGS. 4-10 show an alternate embodiment of a portable rocking chair 200. The seat component is similar to that described above and will be indicated with the same reference characters. In the embodiment of the rocking chair 200 of FIGS. 4-10, the support frame 224 comprises left and right leg hubs 226,228 with a central support member 230 extending therebetween, so the leg hubs are spaced apart from one another by the central support member. The leg hubs 226,228 may be fixedly connected to the central support member 230 or detachably connected to the central support member. The leg hubs 226,228 and central support member 230 may be integral and may be monolithically formed. In a detachable embodiment, the leg hubs 226,228 may have a central support member openings 232,234 to receive the central support member and coaxially fix the hubs on the central support member about a center axis 236. Each of the leg hubs 226,228 may have two leg hub leg member openings 240. Each leg hub leg member opening 240 may receive a leg member 42. The rocking chair 200 may have four leg members 42, for instance, two left leg members associated with the left hub 226 and two right members associated with the right hub 228. The leg hub leg member openings 240 may be angled from each other to allow the leg members to be inserted therein at an angle in order to support the rocking chair 220 when assembled. The angle on each of the hubs 226,228 may be less than or greater than 90 degrees. The leg members may be angled perpendicularly to the central support member center axis or angled axially outward in the direction of the central support member center axis as the leg members 42 project from the leg hubs 226,228.

In the embodiment of FIGS. 4-10, the support frame 224 may have left and right seat hubs 250,252 with a rotating sleeve 254 extending therebetween, so the seat hubs are spaced apart from one another by the rotating sleeve support member. The seat hubs 250,252 may be fixedly connected to the rotating sleeve 254 or detachably connected to the rotating sleeve. The seat hubs 250,252 and rotating sleeve 254 may be integral and may be monolithically formed. In a detachable embodiment, the seat hubs 250,252 may have a rotating sleeve opening 256 to receive the rotating sleeve 254. Each of the seat hubs 250,252 may have two seat hub seat member openings 258. The set member openings 258 of each of the seat hubs 226,228 may receive a seat member 260. The rocking chair may have four seat members 260, for instance, two left seat hub members and two right seat hub members. The seat hub leg member openings 258 may be angled from each other to allow the seat members 260 to be inserted therein at an angle in order to support the seat portion 22 of the rocking chair 220 when assembled. The angle may be less than or greater than 90°. The seat members 260 may be angled perpendicularly to the center axis of the rotating sleeve 254 or angled axially outwardly in the direction of the center axis as the seat members project from the seat hubs 250,252.

The rotating sleeve 254 may be concentrically disposed about the central support member 230 so that the rotating sleeve may rotate relative to the central support member. A torsion spring 270 may be disposed about the central support member 230 in the cylindrical space between the rotating sleeve 234 and the central support member 230. One end of the torsion spring 270 may be formed with "U" shaped hook 272 and the opposite end of the torsion spring may have a straight portion 274. The "U"-shaped hook 272 may cooperate with a radial pin 276 extending through the central support member 230. The radial pin 276 may project radially from both diametrically opposite sides of the central support member 230. The torsion spring straight portion 274 may be received in a spring locator hole 278 formed on an axial face of the seat hub 250,252. The rotating sleeve 254 may cover the torsion spring 270 and the connection of the straight portion 74 into the seat hub spring locator hole 278. Making reference to FIG. 9*a*, as the seat hub 250 rotates relative to the leg hub 228 (clockwise of 'CW' in FIG. 9*a*), the torsion spring 270 may rotate with the seat hub 250 until an inside portion 280 of the "U"-shaped hook 272 engages the radial pin 276*a*, causing the torsion spring to oppose the rotation movement. In a like manner, for opposite rotational motion (counter clockwise or down in FIG. 9*a*), a back 282 of the "U"-shaped hook 272 may engage the diametrical opposite side radial pin 276*b* to oppose counter rotation.

Figure 8A:
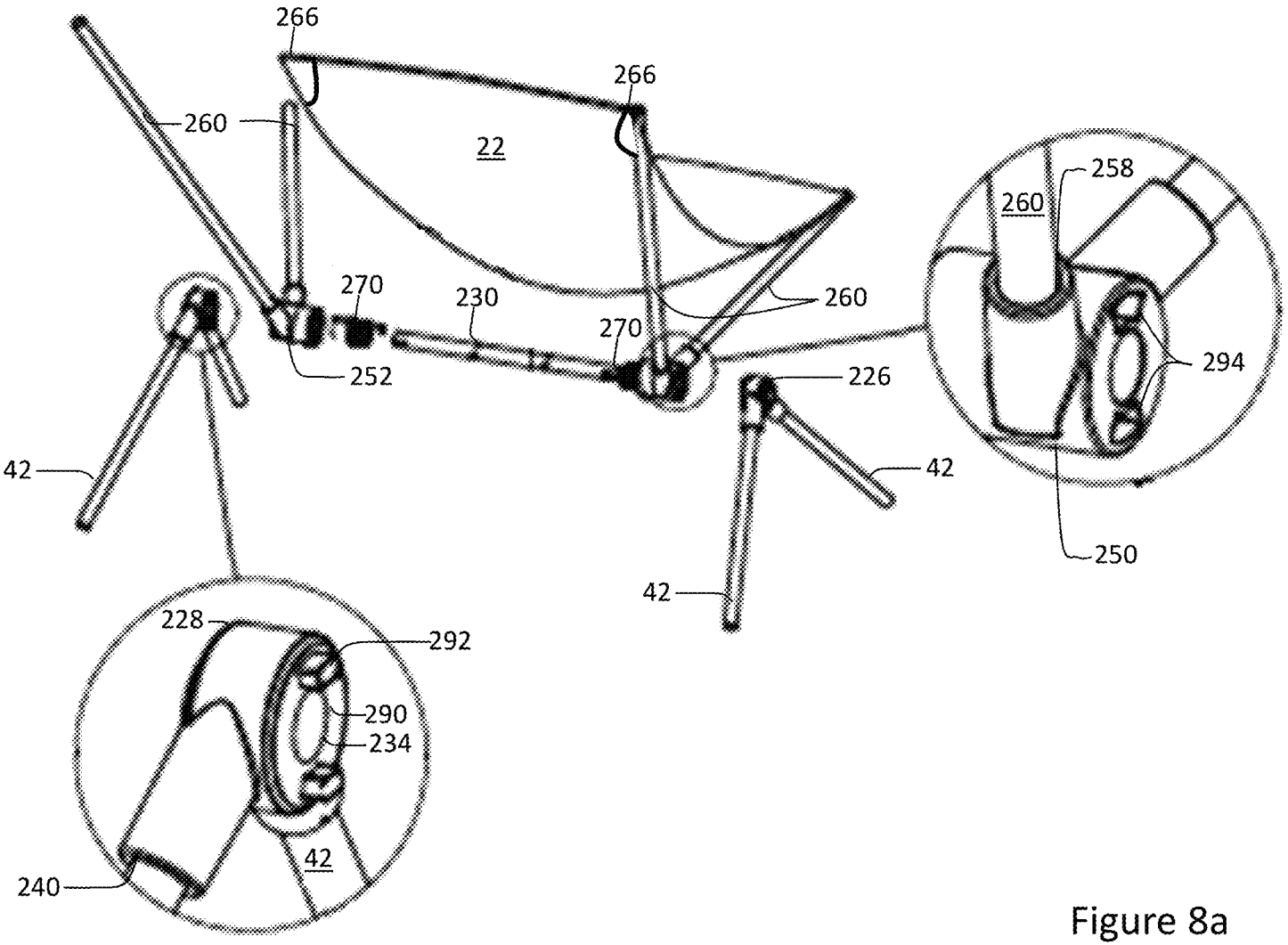
FIGS. 8A and 8B are enlarged views of elements of the support frame of the rocking chair of FIG. 4.
Figure 8B:
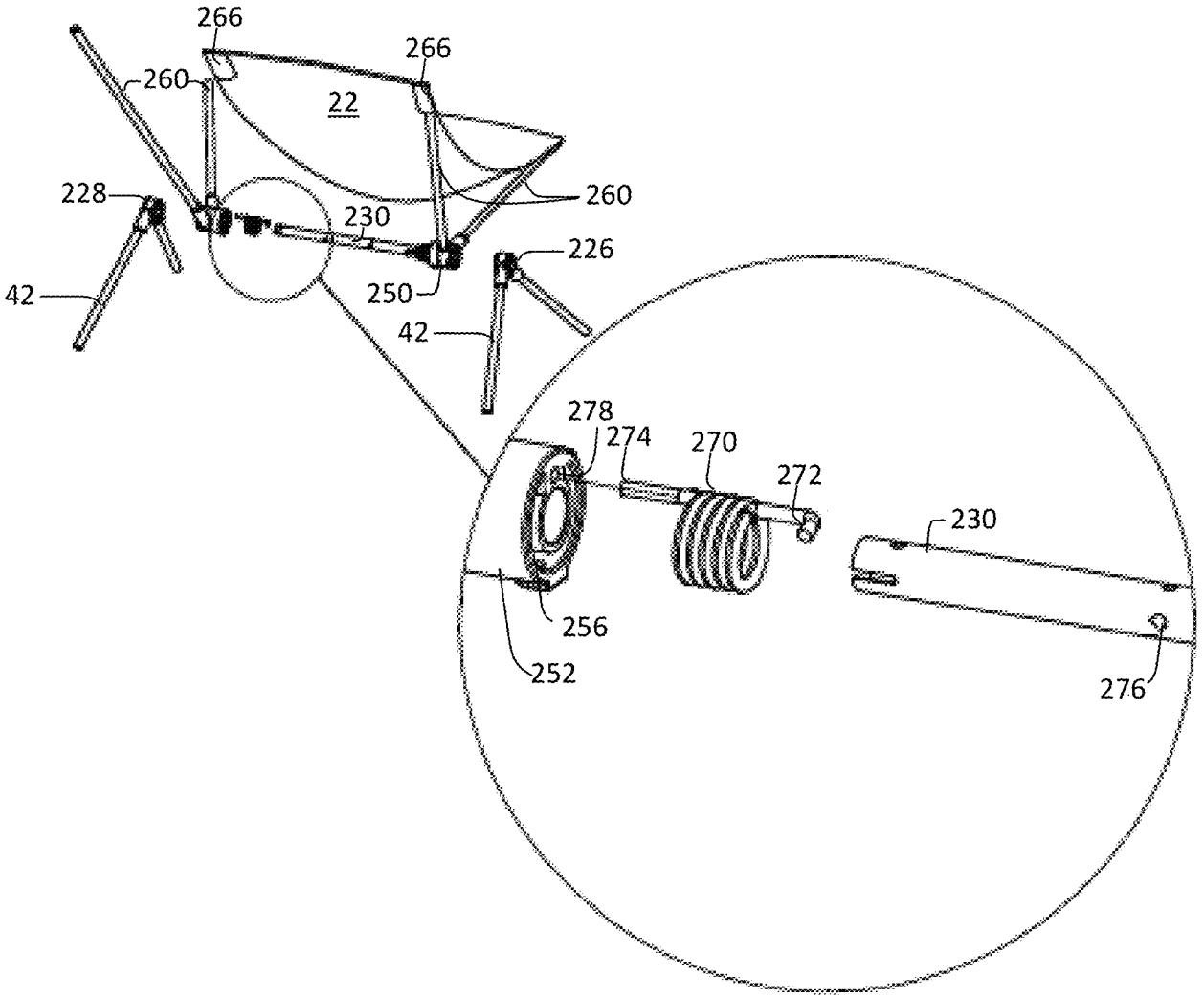
Figure 9B:
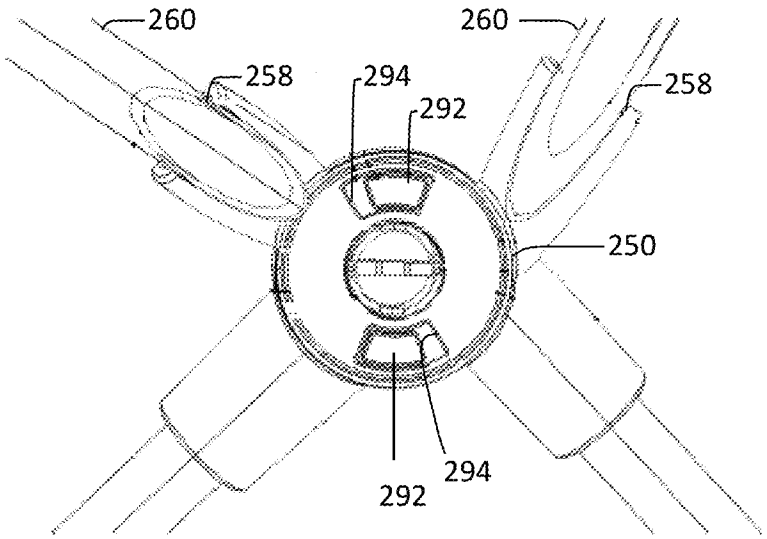
FIGS. 9A and 9B are enlarged views of elements of the support frame of the rocking chair of FIG. 4.
Figure 9A:
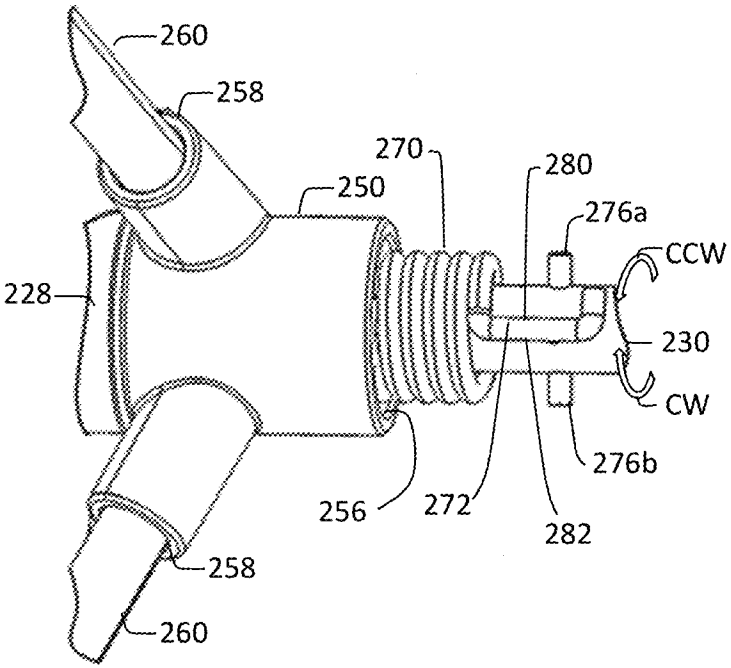

A rotational movement limiter may be provided. As shown in FIGS. 8A and 9B, the leg hub 226,228 axial inward face may be provided with a convex shaped plate 290 having a protuberance 292 and the adjoining seat hub 250,252 axial outward face may be provided with a cooperating slot 294. The slot 294 may have an arcuate length longer than the convex shaped plate protuberance 292. The plate protuberance 292 may be received in the slot 294. Multiple slots and matching protuberances may be provided, for instance, two on each hub as shown in the drawings. As the seat hub 250,252 rotates relative to the respective leg hub 226,228, the plate protuberance 292 may travel within the slot 294 until it engages an end of the slot, thereby limiting relative rotary motion between the seat and leg hub. The geometry of plate protuberance and slot may be reversed. In addition, a system of tabs on the axial faces of the seat and leg hubs may interlock to prevent motion. One or both of the seat and adjoining leg hubs may have the rotation limiter.

Figure 4:
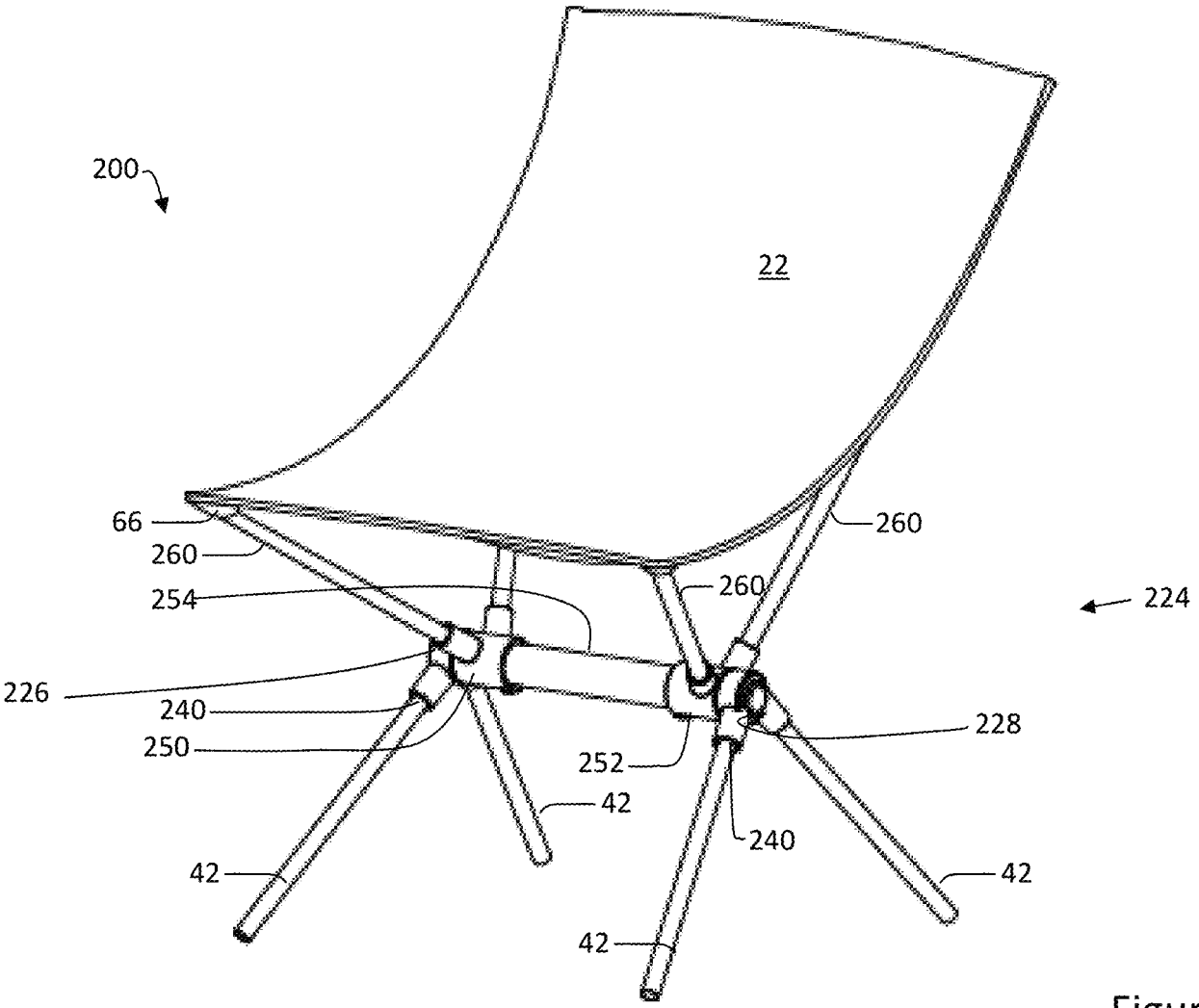
FIG. 4 shows a perspective view of another exemplary rocking chair.
Figure 5:
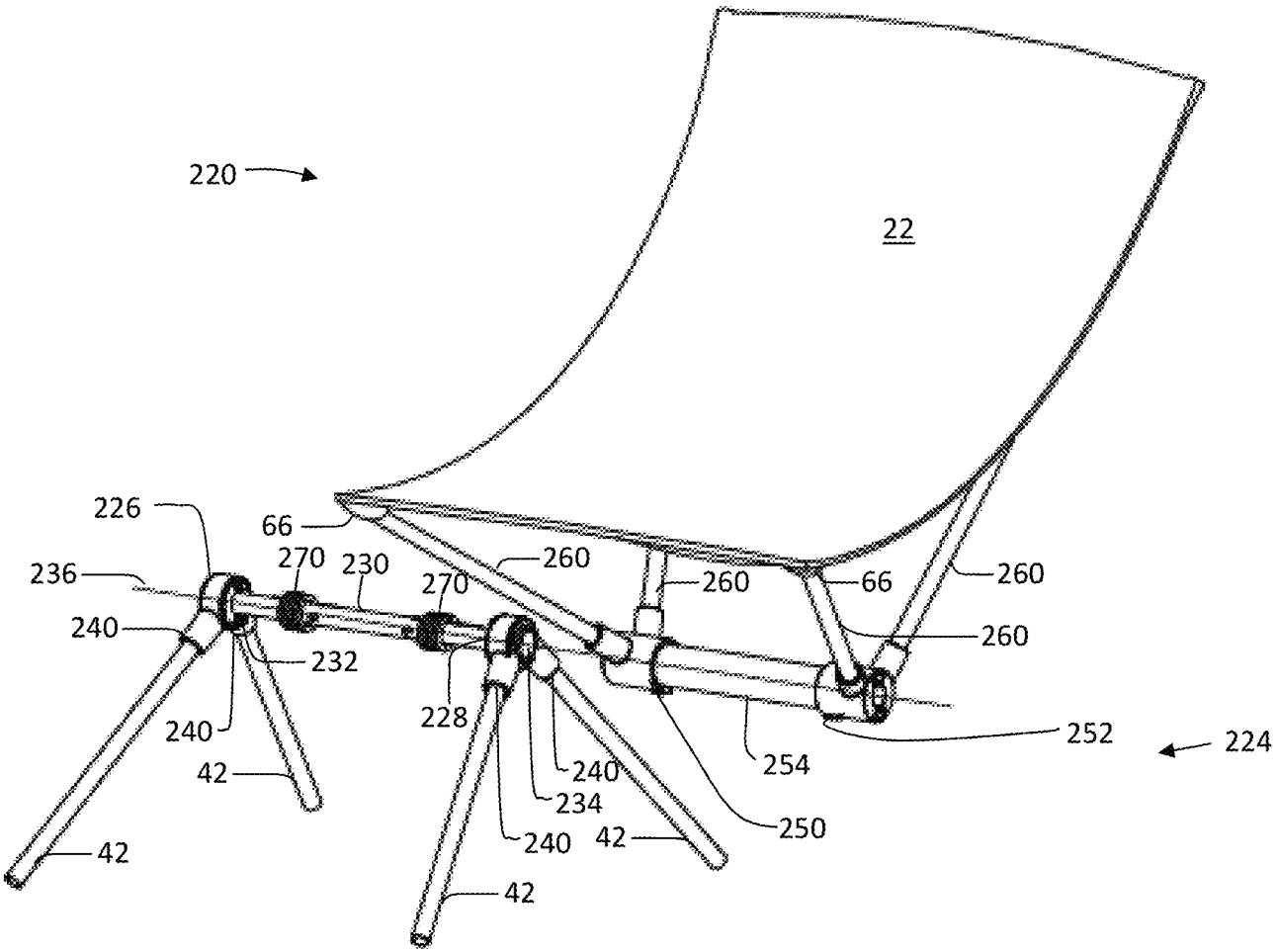
FIG. 5 is an exploded view of the rocking chair of FIG. 4.
Figure 6:
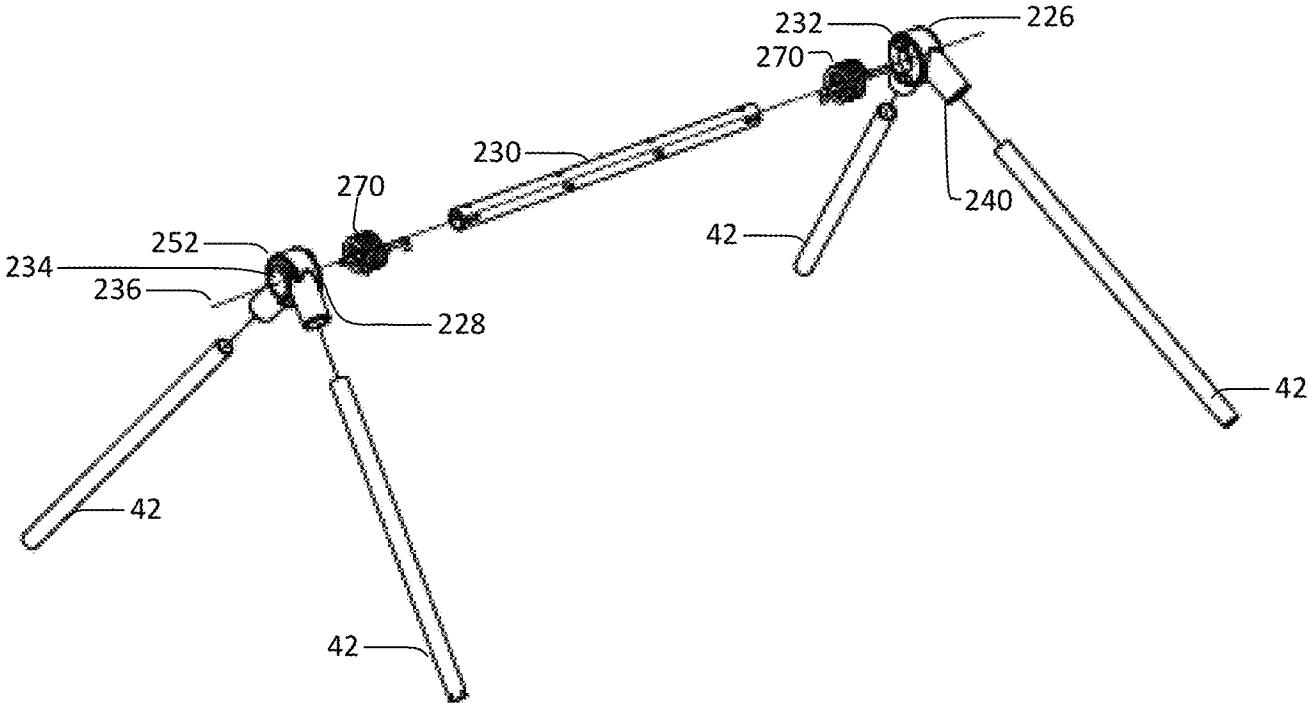
FIG. 6 is an exploded view of elements of a support frame of the rocking chair of FIG. 4.
Figure 7:
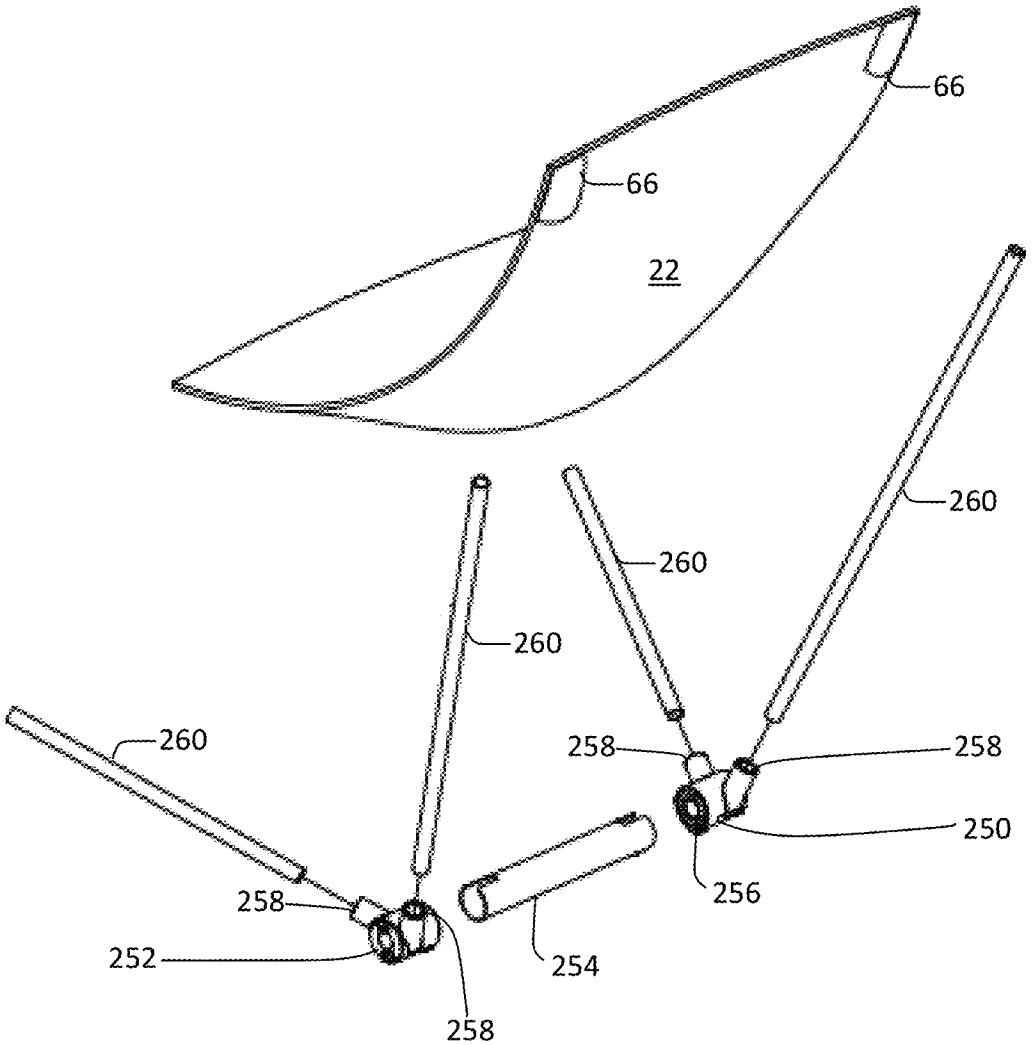
FIG. 7 is an exploded view of other elements of the support frame of the rocking chair of FIG. 4.
Figure 10:
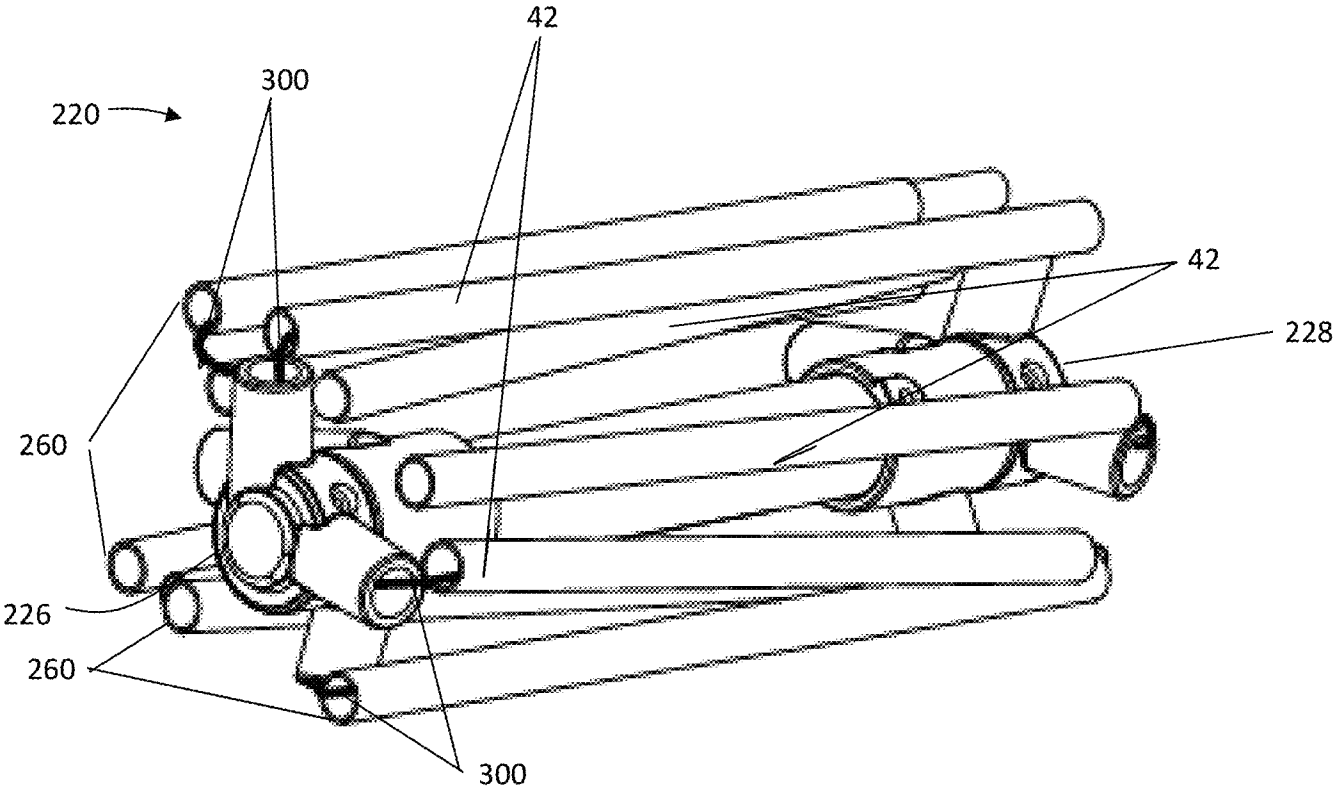
FIG. 10 is a perspective view of the folded rocking chair of FIG. 4 with the support frame in a folded arrangement.

In moving the rocking chair 220 to the expanded arrangement as shown in FIG. 4, the leg members 42 may be inserted into the leg member openings 240 of the left and right leg hubs 226,228. Thereafter, the seat members 260 may be inserted into the seat member openings 258 of the left and right seat hubs 250,252. Then, the seat portion 22 may be assembled to the support frame 224 by inserting the seat members 260 into the seat pocket connectors 66. In folding the rocking chair 220 to a configuration as shown in FIG. 10, the seat portion 22 may be removed from the support frame 224 by removing the seat member from the seat pocket connectors 66. The seat members 260 may be removed from seat member openings 258 of the left and right seat hub 250,252. The seat members 260 may be pivoted and brought into an arrangement parallel to the rotating sleeve 254. Thereafter, the leg members 42 may be removed from the leg member openings 240 of the left and right leg hubs 226,228 and moved to a position parallel to the rotating sleeve 254 as shown in FIG. 10.

To maintain the various members together as an intact unit and to prevent their separation from one another for easy storage, an elastic band 300 may be provided in the center of certain members. For instance, an elastic band may run from each of the seat members 260 to the respective seat hubs 250,252, and from each of the leg members 42 to the respective leg hub 226,228. The elastic bands 300 have a length and stretch that facilitates separation and manipulation of the seat and leg members to thereby allow a compact folding design for the rocking chair, for instance as shown in FIG. 10.

Further embodiments can be envisioned by one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, various modifications and changes may be made thereunto without departing from the broader spirit and scope of the invention as set forth in the claims and that the invention is intended to cover all modifications and equivalents within the scope of the following claims.

What is claimed is:

1. A rocking chair comprising:

a frame comprising:

first and second leg hubs, the first leg hub and the second leg hub each having leg member openings adapted and configured to receive leg members, the first and second leg hubs comprising a leg support frame;

first and second seat hubs, the first seat hub and the second seat hub each having seat member openings adapted and configured to receive seat members, the first and second seat hubs comprising a seat support frame;

leg members adapted and configured to detachably connect to the first and second leg hubs at the leg hub leg member openings;

seat members adapted and configured to detachably connect to the seat hubs at the seat hub seat member openings;

the leg support frame being rotatably connected to the seat support frame with a biasing member extending therebetween configured to urge against rotation in either direction; and a seat adapted and configured to detachably connect to the seat members.

2. The rocking chair of claim 1 further comprising an elastic band extending between at least one leg member and its respective hub.

3. The rocking chair of claim 1 further comprising an elastic band extending between at least one seat member and its respective hub.

4. The rocking chair of claim 1 further comprising a center support member rotatably connected to the first and second leg hubs.

5. The rocking chair of claim 4 wherein the seat hubs rotate with the center support member.

6. The rocking chair of claim 4 wherein the leg hubs have a depending portion engaged with the biasing member.

7. The rocking chair of claim 4 wherein the center support member has an extension portion engaged with the biasing member.

8. The rocking chair of claim 7 wherein the extension portion has a seat member opening adapted and configured to receive a seat member.

9. The rocking chair of claim 7 wherein the extension portion is axially inward of the leg hubs.

10. The rocking chair of claim 7 wherein the seat hubs are axially outward of the leg hubs.

11. The rocking chair of claim 4 wherein the biasing member comprises a coil spring.

12. The rocking chair of claim 11 wherein the rotation of the leg support frame relative to the seat support frame is limited by expansion of the coil spring in one direction and compression of the coil spring in an opposite direction.

13. The rocking chair of claim 1 further comprising a center support member operatively connected to the first and second leg hubs.

14. The rocking chair of claim 13 further comprising a rotating sleeve operatively connected to the first and second seat hubs.

15. The rocking chair of claim 14 wherein the rotating sleeve is adapted and configured to rotate about the center support member.

16. The rocking chair of claim 15 wherein the biasing member operatively engages the center support member and operatively engages the seat hub.

17. The rocking chair of claim 13 wherein the biasing member comprises a torsion spring.

18. The rocking chair of claim 17 wherein the torsion spring has a straight portion that engages the seat hub.

19. The rocking chair of claim 17 wherein the torsion spring has a portion that engages a protrusion on the center support member.

20. The rocking chair of claim 17 wherein the torsion spring has a hooked portion that engages a protrusion on the center support member.

21. The rocking chair of claim 13 wherein at least one of the first and second seat hubs and at least one of the first and second leg hubs that adjoins with the at least one of the first and second seat hubs has cooperating geometry that limits relative rotation therebetween.

22. The rocking chair of claim 21 wherein the cooperating geometry comprises a slot formed on one of the leg hubs and seat hubs and a protuberance formed on the other of the leg hubs and seat hubs.

23. The rocking chair of claim 22 wherein the slot is dimensionally larger than the protuberance.

24. The rocking chair of claim 1 wherein the leg members project from their respective hub leg member openings at an angle less than 90 degrees relative to each other.

25. The rocking chair of claim 1 wherein the seat members project from their seat hub member openings at an obtuse angle relative to each other.

26. A method comprising:

accessing a rocking chair, wherein the rocking chair has a frame comprising:

first and second leg hubs, the first leg hub and the second leg hub each having leg member openings adapted and configured to receive leg members, the first and second leg hubs comprising a leg support frame;

first and second seat hubs, the first seat hub and the second seat hub each having seat member openings adapted and configured to receive seat members, the first and second seat hubs comprising a seat support frame;

leg members adapted and configured to detachably connect to the first and second leg hubs at the leg hub leg member openings;

seat members adapted and configured to detachably connect to the seat hubs at the seat hub seat member openings;

the leg support frame being rotatably connected to the seat support frame with a biasing member extending therebetween configured to urge against rotation in either direction; and a seat adapted and configured to detachably connect to the seat members; and the method further comprising:

inserting the leg members in the leg hub leg member openings;

inserting the seat members in the seat hub seat member openings; and attaching the seat to the seat members.

27. The method of claim 26 wherein the step of inserting the leg members into the leg hub leg member openings further comprises manipulating an elastic band extending between at least one leg member and its respective hub.

28. The method of claim 26 wherein the step of inserting the seat members into the seat hub seat member openings further comprises manipulating an elastic band extending between at least one seat member and its respective hub.

29. The method of claim 26 wherein the seat support frame comprises a center support member rotatably connected to the first and second leg hubs and the center support member has an extension portion engaged with the biasing member; and the method further comprises inserting seat members into seat member openings on the center support member extension.

30. The method of claim 29 further comprises manipulating an elastic band extending between the seat member and its respective extension portion.

* * * * *